US006786679B2

(12) United States Patent
Huang et al.

(10) Patent No.: US 6,786,679 B2
(45) Date of Patent: Sep. 7, 2004

(54) FLOATING STABILITY DEVICE FOR OFFSHORE PLATFORM

(75) Inventors: Edward W. Huang, Houston, TX (US); Frank Shih-Fai Chou, Bellingham, WA (US); Jun Zou, Houston, TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

(21) Appl. No.: 10/163,315

(22) Filed: Jun. 6, 2002

(65) Prior Publication Data

US 2002/0154954 A1 Oct. 24, 2002

Related U.S. Application Data

(63) Continuation-in-part of application No. 09/303,078, filed on Apr. 30, 1999, now Pat. No. 6,371,697.

(51) Int. Cl.[7] ..... B63B 35/44

(52) U.S. Cl. ..... 405/209; 405/205; 405/206; 114/226; 114/264

(58) Field of Search ..... 405/196, 200, 405/203, 204, 205, 206, 209; 114/256, 266, 264

(56) References Cited

U.S. PATENT DOCUMENTS

| | | | | |
|---|---|---|---|---|
| 3,360,810 A | | 1/1968 | Busking | |
| 3,408,821 A | * | 11/1968 | Redshaw | 405/200 |
| 3,472,032 A | | 10/1969 | Howard | |
| 3,572,041 A | | 3/1971 | Graaf | |
| 3,693,361 A | * | 9/1972 | Koehler | 405/209 |
| 3,760,875 A | | 9/1973 | Busking | |
| 3,778,854 A | | 12/1973 | Chow | |
| 3,889,476 A | | 6/1975 | Gerin | |
| 4,060,995 A | | 12/1977 | Lacroix et al. | |
| 4,098,333 A | | 7/1978 | Wells et al. | |
| 4,118,942 A | * | 10/1978 | Liautaud | 405/204 |
| 4,126,011 A | * | 11/1978 | Lamy et al. | 405/196 |
| 4,181,453 A | | 1/1980 | Vache | |
| 4,470,723 A | | 9/1984 | Michel et al. | |
| 4,473,323 A | | 9/1984 | Gregory | |
| 4,626,137 A | | 12/1986 | Willemsz | |
| 4,702,321 A | | 10/1987 | Horton | |
| 4,913,238 A | | 4/1990 | Danazcko et al. | |
| 4,934,871 A | | 6/1990 | Kazokas, Jr. | |
| 4,966,495 A | | 10/1990 | Goldman | |
| 4,983,073 A | | 1/1991 | Petty et al. | |
| 5,088,858 A | * | 2/1992 | Massoudi | 405/203 |
| 5,330,293 A | | 7/1994 | White et al. | |
| 5,381,865 A | | 1/1995 | Blandford | |
| 5,403,124 A | * | 4/1995 | Kocaman et al. | 405/209 |
| 5,421,676 A | | 6/1995 | Wybro et al. | |
| 5,439,060 A | | 8/1995 | Huete et al. | |
| 5,439,321 A | | 8/1995 | Hunter | |
| 5,447,392 A | | 9/1995 | Marshall | |
| 5,480,265 A | | 1/1996 | Marshall et al. | |
| 5,480,266 A | | 1/1996 | Marshall et al. | |
| 5,551,802 A | | 9/1996 | Wybro | |
| 5,567,086 A | | 10/1996 | Huete | |
| 5,584,607 A | | 12/1996 | Baan | |

(List continued on next page.)

*Primary Examiner*—Frederick L. Lagman
(74) *Attorney, Agent, or Firm*—Bracewell & Patterson, L.L.P.

(57) ABSTRACT

An offshore well platform is towed in an upright condition to a well site by the use of a temporary flotation device. The flotation device mounts to a portion of the platform and is partially submerged, increasing the ability and buoyancy of the platform. At the site, the engagement of the flotation device shifts to a deploying position. In the deploying position, the ballast of the platform is increased to cause it to more deeply submerge. The flotation device remains at least partially surrounding the platform and floating while the platform moves downwardly relative to it. This provides lateral support if needed to prevent heeling while being submerged. The flotation device is disengageable from the platform when the platform is fully submerged.

23 Claims, 4 Drawing Sheets

U.S. PATENT DOCUMENTS 5,588,781 A 12/1996 Smolinski et al.
5,609,442 A 3/1997 Horton
5,642,966 A 7/1997 Morrison et al.
5,706,897 A 1/1998 Horton, III
5,775,845 A 7/1998 Wybro
5,791,819 A 8/1998 Christiansen
5,833,397 A 11/1998 Horton, III
5,997,218 A * 12/1999 Børseth ..... 405/223.1
6,244,785 B1 * 6/2001 Richter et al. ..... 405/195.1
6,503,023 B2 1/2003 Huang et al.

* cited by examiner

Fig. 4
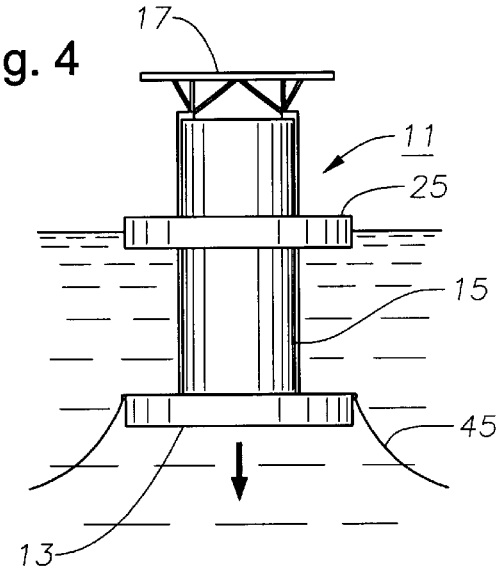
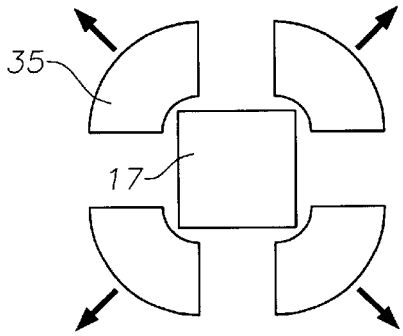
Fig. 5
Fig. 6
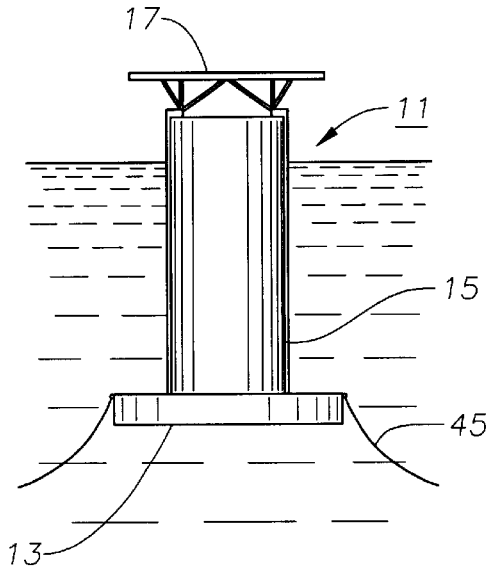
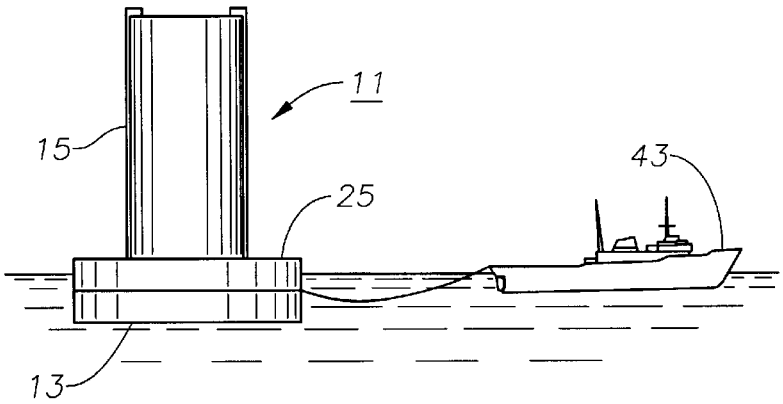
Fig. 7

Fig. 8
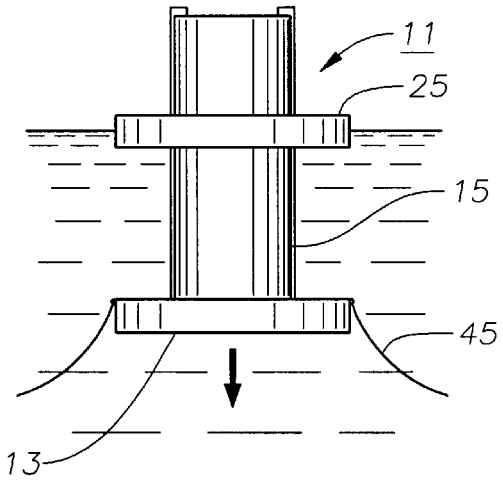
Fig. 11
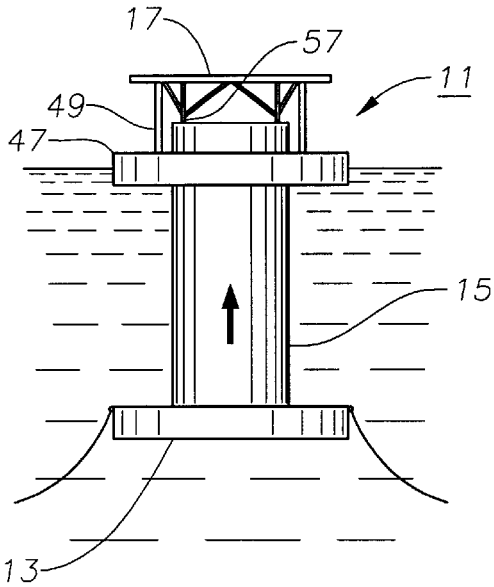
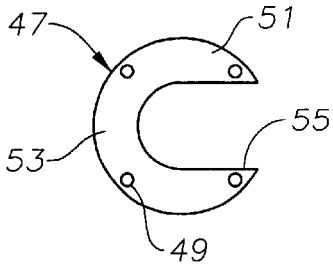
Fig. 10
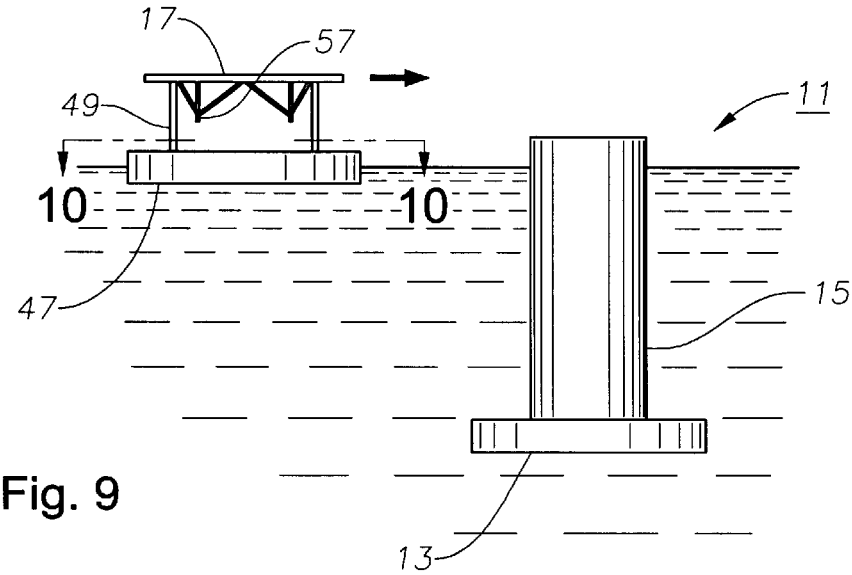
Fig. 9

FLOATING STABILITY DEVICE FOR OFFSHORE PLATFORM

This invention is a continuation-in-part application of Ser. No. 09/303,078, filed Apr. 30, 1999, now U.S. Pat. No. 6,371,697, entitled Floating Vessel for Deep Water Drilling and Production.

BACKGROUND OF THE INVENTION

1. Field of the Invention

The present invention relates to floating vessels used for offshore drilling and production of petroleum.

2. Description of the Related Art

Petroleum production often requires the placement of rig in an offshore location. In shallower waters, the rigs and production facilities can be placed on freestanding offshore platforms. As the water becomes deeper, however, these become impractical, and it is necessary to have a floating platform, or support vessel, upon which the rigs and production facilities can be placed.

One type of deepwater support vessel is a tension leg platform (TLP). The TLP is a buoyant platform that is secured to the seabed using generally vertically-oriented rigid tethers or rods that restrain the platform against vertical and horizontal motion relative to the well in the seabed below. These platforms have a very short period in response to wave action.

An alternative to the TLP is the deep draft caisson vessel (DDCV). The DDCV is a free floating vessel that is moored to the seabed using flexible tethers so that vertical and horizontal motion of the vessel is restrained, although not eliminated . Examples of DDCVs are found in U.S. Pat. No. 4,702,321.

Methods for restraining the DDCVs attempt to slow, rather than eliminate, the natural response period of the vessel to wave effects. Current DDCV arrangements "decouple" the vessel from the individual wells being supported so that the wells are not subject to the same induced motions as the vessel. Decoupling is typically accomplished by using buoyant means to make the wells separately freestanding and using flexible hoses to interconnect the vertical risers from the well to the production facilities.

A common variety of DDCV is the type shown in U.S. Pat. No. 4,702,321, which utilizes a long cylindrical structure and is commonly known as a spar. The long cylindrical shape of the spar provides a very stable structure when the vessel is in its installed position, exhibiting very slow pitch, surge and heave motions. Heave motion, however, is not totally eliminated, allowing the structure to bob up and down vertically in the sea. Recently, attempts have been made to add a number of horizontally extending plates along the length of the spar in order to help the spar be more resistant to heave.

Regardless of the presence of the plates, the spar must be assembled and transported in a horizontal position and then installed by being upended at or near the final site using a large crane that must also be transported to the installation site. As these caisson structures are often around 650 ft. in length, transport and upending of the structure are risky. Further, it is only after a successful upending of the structure has occurred, and the lower portion of the structure has been successfully moored, that components of the rig can be placed atop the spar.

SUMMARY OF THE INVENTION

In this invention, a platform is provided that has a variable ballast. A flotation device is coupled to the platform to increase the buoyancy of the platform. The flotation device causes the platform to float in a towing position with the platform and the flotation device partially submerged. The flotation device is fixed to the platform while in the towing position, and the platform is towed upright. When at the site, the flotation device is moved to a deploying position. In the deploying position, the flotation device remains in close proximity with a portion of the platform, but is not fixed to it vertically. As ballast is increased in the platform, the platform moves downward relative to the flotation device. The flotation device remains floating closely spaced to a portion of the platform. If the platform heels while lowering, it will contact the flotation device, which provides lateral stability against heeling. Once the platform has been submerged sufficiently so that it is stable, the flotation device is released from the platform.

In the preferred embodiment, the platform has an upper elongated tower section and a lower base section. The base section has a greater cross-sectional dimension than the tower section. The flotation device is preferably annular and fits on top of the base section, surrounding a lower portion of the tower section. Preferably the flotation device is formed in circumferentially extending segments. The segments are separable from each other. The flotation device is disengaged from the platform by uncoupling the segments from each other and pulling them laterally outward from the platform.

In the first embodiment, the upper deck structure of the platform is mounted to the platform before the platform is towed to the desired location. In the second embodiment, the upper deck structure is installed at the location. This is handled by mounting the upper deck structure on a buoyant member and towing the buoyant member to the location. The buoyant member has two spaced-apart arms, resulting in a slot. The arms are spaced apart from each other sufficiently to allow the arms of the buoyant member to float on opposite sides of the platform after the platform has been fully deployed and the flotation device removed. The arms support the upper deck structure at a distance above the upper end of the platform. Once in place over the platform, the platform buoyancy is increased, allowing the platform to rise up into contact with the upper deck structure. The deck structure is then secured to the platform, and the buoyant member is then moved laterally away from the structure.

BRIEF DESCRIPTION OF THE DRAWINGS

FIG. 4 is a schematic side elevational view of the flotation device and platform of FIG. 1, showing the platform being lowered relative to the flotation device.

FIG. 5 is a schematic top view of the platform and flotation device of FIG. 1, showing the segments of the flotation device separated from each other and being towed away from the platform.

FIG. 6 is a schematic side elevational view of the platform of FIG. 1 in its fully installed position.

FIG. 7 illustrates an alternate method, wherein the platform of FIG. 1 is towed to the site without its upper deck structure.

FIG. 8 is a schematic side elevational view of the platform of FIG. 7, showing it being lowered further into the sea relative to the flotation device.

FIG. 9 is a schematic side elevational view of the platform of FIG. 7, shown in a submerged position, and showing the upper deck structure being floated over it by means of a buoyant member.

FIG. 10 is a sectional view of the buoyant member of FIG. 9, taken along the line 10—10 of FIG. 9.

FIG. 11 is a schematic side elevational view of the platform of FIG. 8, showing the buoyant member around the upper end of the platform, with the platform raised up into contact with the upper deck structure.

DETAILED DESCRIPTION OF THE INVENTION

Figure 1:
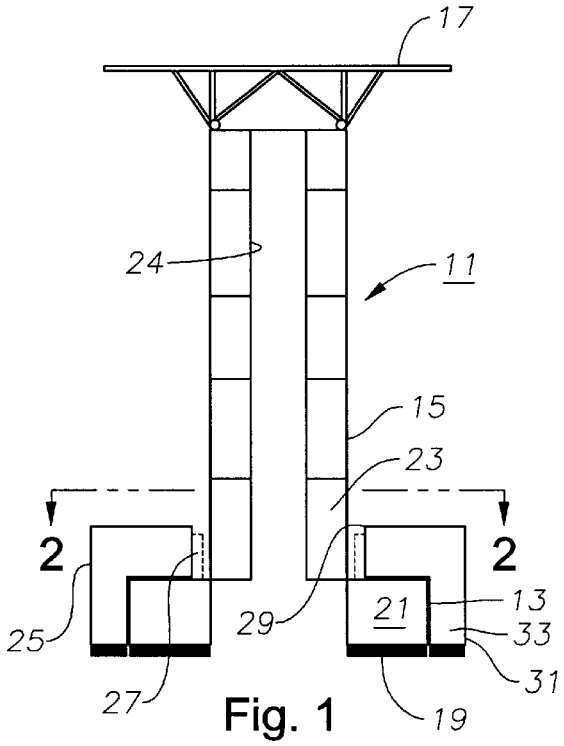
FIG. 1 is a schematic sectional view of a platform and flotation device constructed in accordance with this invention.

Referring to FIG. 1, platform 11 has a base section 13 and a tower section 15. Base section 13 has a greater horizontal cross-sectional area than the cross-sectional area of tower section 15. In the preferred embodiment, both base section 13 and tower section 15 are cylindrical. Base section 13 has a vertical height that is much less than the vertical height of tower section 15.

An upper deck structure 17 is schematically shown mounted on the upper end of tower section 15. Upper deck structure 17 may in some instances comprise drilling equipment, including a derrick, living quarters and associated machinery. Upper deck structure 17 may also comprise production equipment for separating gas and water from well fluids and processing the oil or gas. Alternately, upper deck structure 17 could be a much simpler structure, such a deck for helicopter landing. In the latter instance, tower section 15 and base section 13 could be employed for storing chemicals and the like, in which case platform 11 serves as a tender to a production or drilling vessel.

Preferably base section 13 has a section of fixed ballast 19 such as heavy metal. Additionally, base section 13 has at least one ballast chamber 21, which is a watertight chamber that can be flooded selectively with water to increase the ballast or pumped free of water to decrease the ballast. Tower section 15 also has a number of ballast chambers 23, each of which may be selectively filled with water or pumped free of water. In this embodiment, a central vertical passage 24 extends downward through tower section 15 and base section 13. Central passage 24 allows drilling tools to be lowered from upper deck structure 17 into the sea. If platform 11 is employed as a tender, the lower end of base section 13 would preferably be closed against sea water, and central passage 24 would be used for transporting materials and personnel from base section 13 to upper deck structure 17.

A flotation device 25 is shown mounted on platform 11. Flotation device 25 is a buoyant member, preferably a tank that is filled with air and sealed from water to provide a buoyant chamber. In this embodiment, flotation device 25 is annular and secured to platform 11 by a set of fasteners 27, shown by dotted lines. Fasteners 27 are illustrated to be located on an inner diameter 29 of flotation device 25 for engaging the top of base section 13. Fasteners 27 could alternately engage tower section 15 or both tower section 15 and base section 13. Fasteners 27 may be a variety of types of clamps or locking members either mechanically or hydraulically actuated.

Flotation device 25 in the embodiment of FIG. 1 has an outer diameter 31 that is greater than the outer diameter of base section 13. A lower portion of the outer diameter 31 surrounds the outer diameter of base section 13. This results in an outer lower portion 33 that extends downward flush with the lower end of base section 13. Fixed ballast such as ballast 19 may optionally be located in the lower end of outer lower portion 33. Outer lower portion 33 is not essential and in some cases, the lower end of flotation device 25 could be flush with the top of base section 13. In that case, outer diameter 31 of flotation device 25 could be the same or even less than the outer diameter of base section 13.

Figure 2:
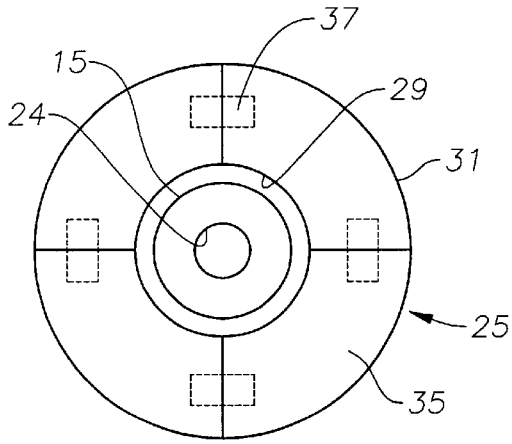
FIG. 2 is a schematic side elevational view of the platform and flotation device of FIG. 1, taken along the line 2—2 of FIG. 1.

As shown in FIG. 2, flotation device 25 is preferably constructed in a plurality of separate circumferentially extending segments 35. Four segments 35 are shown, although this number could be more or less. Segments 35 are assembled and coupled to each other in the annular configuration shown in FIG. 2 by fasteners 37. Fasteners 37, similar to fasteners 27, could be of many different types, such as clamps or locks, either hydraulically or mechanically actuated. Each segment 35 is a separate sealed, watertight member so that each is independently buoyant.

Figure 3:
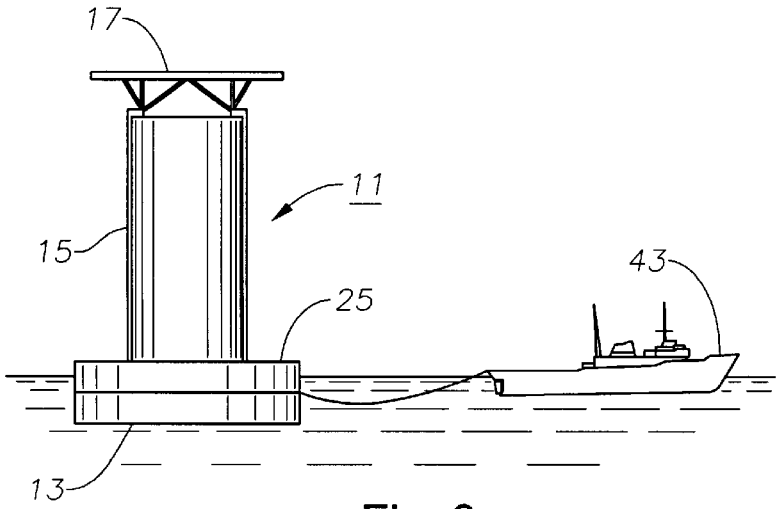
FIG. 3 is a schematic side elevational view illustrating the platform and flotation device of FIG. 1 being towed to a site.

Flotation device 25 is employed to provide additional buoyancy to platform 11 to increase the stability of platform 11 while it is being towed upright to a desired location, shown in FIG. 3, and also to stabilize platform 11 while it is being submerged to the desired position as illustrated in FIG. 4. The dimensions of flotation device 25 are developed by known principles. Once installed on base section 13, base section 13 will be fully submerged and flotation device 25 will be partly submerged. Lower outer portion 33 of flotation device 25 will be fully submerged. The horizontal cross-sectional area of flotation device 25 significantly increases the water plan of platform 11 while being towed, the water plan being the surface area of platform 11 and flotation device 25 measured at the waterline. The increased water plan greatly increases the stability of platform 11 while being towed.

Figure 13:
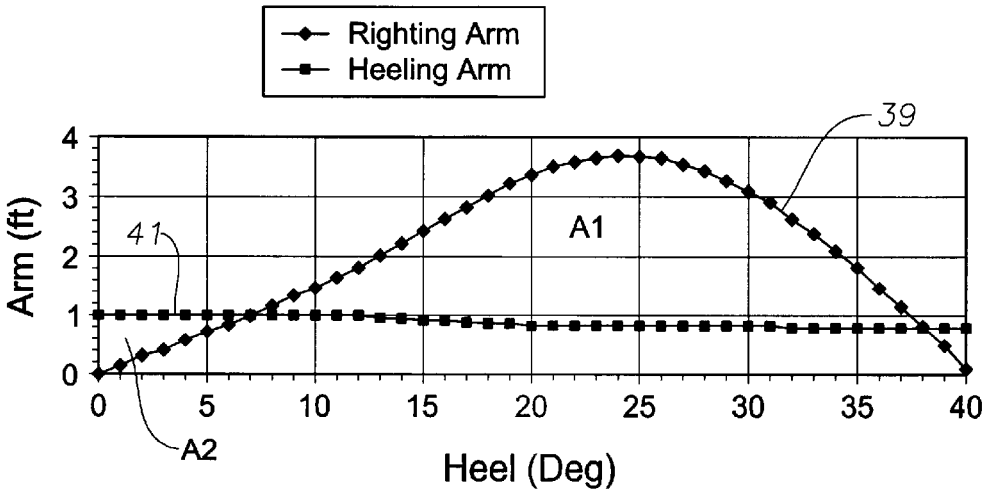
FIG. 13 is a graph illustrating an example of a righting arm and a heel arm of the platform and flotation device of FIG. 1 being towed under selective wind conditions.

Referring to FIG. 13, the graph is representative of a righting arm curve 39 and a heeling arm curve 41 of platform 11 when assembled with flotation device 25. Righting arm curve 39 represents the ability of the assembled platform 11 and flotation device 25 to right itself if it is being heeled due to strong winds. In the example of FIG. 13, the wind is assumed to be 70 knots. As the amount of heel increases to around 25°, righting arm curve 39 increases, and therefore the ability of platform 11 to right itself also increases. The heeling arm 41 decreases slightly as the heel increases because as the platform 11 heels more, it presents less structure normal to the wind. The area A1 under righting arm curve 39 and above heeling arm curve 41 should be greater than the area A2. The area A2 is the area under heeling arm curve 41 and above righting arm curve 39 to the first point where they cross, which is about 7° in the example shown. For stability, the ratio of A1 over A2 in many cases should be at least 1.4. In the example shown, it is 2.53, presenting a stable configuration for towing even in a 70 knot wind.

The graph of FIG. 13 will change for the same structure at different wind speeds. Also, the graph of FIG. 13 changes as tower section 15 is more deeply submerged. At the fully installed depth, there will be no point at which the righting arm curve 39 crosses the heeling arm curve 41 because of its extensive depth. That is, once installed, even if heeled to 40°, the righting arm will be greater than the heeling arm, preventing capsizing.

If a graph such as FIG. 13 is plotted for the platform 11 without flotation device 25, the area A1 would still be greater than the area A2, but the ratio would be much less than 2.53. Adding flotation device 25 improves the righting ability because it adds buoyancy and also creates a greater water plan. Without flotation device 25, the water plan would only be the cross-sectional area of tower section 15, considerably less than if combined with the water plan of flotation device 25. Flotation device 25 also lowers the vertical center of gravity.

In one example, the overall height from the lower end of base section 13 to upper deck structure 17 is 200 ft. Base section 13 has a diameter of 108 ft. and a height of 30 ft. Tower section 15 is cylindrical with an outer diameter of 50 ft. and an inner diameter of 20 ft. Flotation device 25 has an outer diameter 31 of 136 ft and an inner diameter 29 of 64 feet. In this example, the water plan of flotation device 25 is much greater than the water plan of tower section 15. The water plan of tower section 15 is pi times the square of the radius, approximately 1962 square feet, and the water plan of flotation device 25 is pi times outer diameter 31 divided by two and squared less inner diameter 29 divided by two and squared, approximately 11,304 square feet. The height of the portion of flotation device 25 extending above base section 13 is 20 ft, resulting in an overall height at outer diameter 31 of 50 feet. This produces a draft while towing of 29.50 ft. and a vertical center of gravity of 45.47 ft. Of course, platform 11 and flotation device 25 may have different dimensions than those listed above.

Referring again to FIG. 3, in operation, flotation device 25 will be assembled and secured to platform 11 by fasteners 27 (FIG. 1). A tow vessel 43 will be secured to base section 13 for towing platform 11 to a desired location. Once at the desired location, as shown in FIG. 4, moorings 45 will be attached to the sea floor. Fasteners 27 (FIG. 1) will be released to place flotation device 25 in the deploying mode. Platform 11 is now free to move downward relative to flotation device 25, although flotation device 25 is retained with tower section 15 because it still surrounds it. Because inner diameter 29 of flotation device 25 is greater than the outer diameter of tower section 13 by a clearance on a side of seven feet, flotation device 25 will not initially be in physical contact with tower section 13. Water is pumped into ballast chambers 21 and 23 (FIG. 1), causing platform 11 to move downward. As it moves downward, flotation device 25 provides lateral stability by remaining in place surrounding platform tower section 15. That is, should platform 11 begin to heel, tower section 15 would contact part of inner diameter 29 of flotation device 25, which would add stability. Prior to reaching a certain depth, platform 11 will still be unstable, therefore flotation device 25 adds stability during this deploying movement.

Once platform 11 has been submerged to a depth in which it is stable, such as about 120 ft. in the above example, there will be no degree of heel in which the righting arm curve 39 (FIG. 13), drops below the heeling arm curve 41. At this point, if desired, flotation device 25 could be disengaged from tower section 15. Alternately, the operator may wish to completely deploy platform 11 to its final depth before detaching flotation device 25. In the above example of dimensions for platform 11, the draft while fully deployed is about 160 ft.

Flotation device 25 is disengaged from tower section 15 as illustrated in FIG. 5. Fasteners 37 (FIG. 2) are released to enable segments 35 to separate and segments 35 are pulled radially outward from platform 11. Flotation device 25 may be reassembled, towed back to land and reused. FIG. 6 shows platform 11 at its fully deployed depth with flotation device 25 removed.

FIG. 7 illustrates an alternate method for deploying platform 11. In FIG. 7, upper deck structure 17 is left off initially. This reduces the amount of weight at the upper end of platform 11. Flotation device 25 is assembled on base section 13 and towed to the site by vessel 43. Then, as illustrated in FIG. 8, platform 11 is moored by moorings 45 and fasteners 27 (FIG. 1) are moved to the deploying position. The ballast of platform 11 is increased by pumping water into it, causing it to lower as shown in FIG. 8 while flotation device 25 remains floating. Once platform 11 is stable, flotation device 25 is removed.

Referring to FIG. 9, preferably, platform 11 is overballasted to a depth somewhat deeper than its desired draft when fully installed. Upper deck structure 17 is towed separately to the site on a buoyant member 47. Buoyant member 47 has the shape of a horseshoe, as shown in FIG. 10. It has vertical columns 49 that support upper deck structure 17 above buoyant member 47. Columns 49 are located on two spaced-apart buoyant arms 51. Arms 51 are parallel to each other and join each other at a base 53. The end opposite base 53 is open, defining a slot 55 between the free ends of arms 51. Slot 55 has a width greater than the width or diameter of tower section 15. This enables buoyant member 47 to be towed and pushed around the upper portion of tower section 15, as shown in FIG. 11, with arms 51 on opposite sides of tower section 15.

Figure 12:
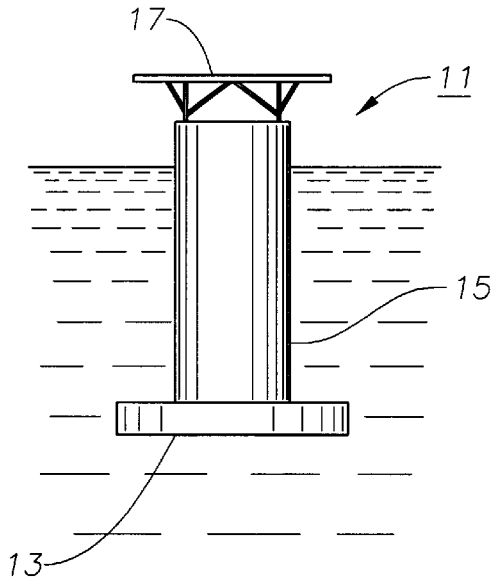
FIG. 12 is a schematic side elevational view of the platform of FIG. 7, shown fully installed with the upper deck structure.

Initially, the lower ends or legs 57 of upper deck structure 17 are spaced above the upper end of tower section 15. Then, the buoyancy in platform 11 is increased, causing the upper end of tower section 15 to come up into engagement with legs 57. Tower section 15 will lift upper deck structure 17 from buoyant member 47, and legs 57 will be secured to the upper end of tower section 15. Then, as illustrated in FIG. 12, buoyant member 47 is removed along with columns 49. This is done by towing buoyant member 47 laterally outward from tower section 15.

The invention has significant advantages. The flotation device increases the stability while towing of the platform, enabling the platform to be towed in an upright condition. The platform therefore does not need to be towed horizontally, then upended for deploying. The flotation device also adds stability while the vessel is being deployed at the site, resisting heeling by encircling the tower section. The flotation device is readily removed from the tower once it is submerged to a depth of stability. This allows the flotation device to be reused or recycled.

While the invention has been shown in only two of its forms, it should be apparent to those skilled in the art that it is not so limited but susceptible to various changes without departing from the scope of the invention. For example, the platform may be configured in other shapes other than cylindrical. Although, preferred, the platform need not have larger diameter base section and a smaller diameter tower section. Also, the flotation device could be configured in other shapes rather than annular. Additionally, devices such as rollers could be mounted to the inner diameter of the flotation device to contact the tower section while the platform is being submerged.

We claim:

1. A method for deploying an offshore well facility, comprising:

(a) providing a platform with a variable ballast;

(b) fastening a flotation device to the platform in a manner to increase buoyancy of the platform, the flotation device causing the platform to float in a towing position with the platform and the flotation device partially submerged; then (c) towing the platform and the flotation device to a desired location; then (d) increasing the ballast of the platform, and unfastening the flotation device so that the platform moves downward relative to the flotation device to a deeper partially submerged but floating position while retaining the flotation device floating adjacent a portion of the platform to provide stability against heeling; then (e) removing the flotation device from a vicinity of the platform while the platform remains floating.

2. The method according to claim 1, wherein step (b) comprises securing the flotation device adjacent a lower base section of the platform: and step (c) comprises towing the platform to the desired location while the flotation device remains adjacent the lower base section.

3. The method according to claim 1, wherein step (b) comprises rigidly securing the flotation device to the platform; and step (c) comprises towing the platform to the desired location while the flotation device remains rigidly secured to the platform.

4. The method according to claim 1, wherein:

step (a) comprises providing the platform with an upper vertically elongated tower section and a lower base section having a horizontal cross-sectional area greater than the tower section;

step (b) comprises mounting the flotation device to the lower base section; and step (c) comprises towing the platform to the desired location while the flotation device remains mounted to the lower base section; and step (d) comprises releasing the flotation device from the lower base section but retaining the flotation device adjacent the tower section as the platform moves downward.

5. The method according to claim 1, wherein:

step (a) comprises providing the platform with an upper vertically elongated tower section and a lower base section having a horizontal cross-sectional area greater than the tower section, and providing the flotation device with a water plan that is greater than a water plan of the tower section;

step (b) comprises rigidly mounting at least a portion of the flotation device directly on top of the base section around the tower section;

step (c) comprises towing the platform to the desired location while the flotation device remains directly on top of the base section: and step (d) comprises releasing the flotation device from its position directly on top of the base section but retaining the flotation device around the tower section as the platform moves downward.

6. The method according to claim 1, wherein while in the towing position, the flotation device has a greater water plan than the platform.

7. A method for deploying an offshore well facility, comprising:

(a) providing a platform with a variable ballast:

(b) fastening a flotation device to the platform in a manner to increase buoyancy of the platform, the flotation device causing the platform to float in a towing position with the platform and the flotation device partially submerged; then (c) towing the platform and the flotation device to a desired location; then (d) increasing the ballast of the platform, and unfastening the flotation device so that the platform moves downward relative to the flotation device to a deeper partially submerged position while retaining the flotation device floating adjacent a portion of the platform to provide stability against heeling; then (e) removing the flotation device from a vicinity of the platform; and wherein step (a) comprises providing the platform with an upper vertically elongated tower section and a lower base section having a horizontal cross-sectional area greater than the tower section;

step (b) comprises forming the flotation device into an annular configuration with separable segments, and mounting at least a portion of the flotation device on top of the base section and around a lower portion of the tower section;

step (d) comprises leaving the flotation device around the tower section as the platform moves downward; and step (e) comprises separating at least some of the segments from each other and pulling them laterally outward from the tower section.

8. A method for deploying an offshore well facility, comprising:

(a) providing a platform with a variable ballast:

(b) fastening a flotation device to the platform in a manner to increase buoyancy of the platform, the flotation device causing the platform to float in a towing position with the platform and the flotation device partially submerged; then (c) towing the platform and the flotation device to a desired location; then (d) increasing the ballast of the platform, and unfastening the flotation device so that the platform moves downward relative to the flotation device to a deeper partially submerged position while retaining the flotation device floating adjacent a portion of the platform to provide stability against heeling; then (e) removing the flotation device from a vicinity of the platform; and after the flotation device is disengaged:

mounting an upper deck structure on a buoyant member that has two laterally spaced apart arms;

floating the arms on opposite sides of an upper portion of the platform, with the deck structure spaced above an upper end of the platform; then allowing the platform to become less submerged, causing the upper end of the platform to contact and support the deck structure; then attaching the deck structure to the upper end of the platform and removing the buoyant member.

9. A method for deploying an offshore well facility, comprising:

(a) providing a platform with an elongated upper tower section and a lower base section, the base section having a greater horizontal cross-sectional than the tower section;

(b) securing a flotation device to the base section at least partially surrounding the tower section, the flotation device causing the platform to float in a towing position with the base fully submerged and the flotation device partially submerged; then (c) towing the platform and the flotation device to a desired location while the flotation device remains secured to the base section; then (d) releasing the flotation device from the base section to allow downward vertical movement of the platform relative to the flotation device while the flotation device remains floating and at least partially surrounding the tower section, and pumping water into a chamber of the platform to cause the platform to move downward relative to the flotation device to a deeper partially submerged but still floating position; then (e) disengaging the flotation device from the tower section while the platform remains floating.

10. A method for deploying an offshore well facility, comprising:

(a) providing a platform with an elongated upper tower section and a lower base section, the base section having a greater horizontal cross-sectional than the tower section;

(b) securing a flotation device to the base section at least partially surrounding the tower section, the flotation device causing the platform to float in a towing position with the base fully submerged and the flotation device partially submerged; then (c) towing the platform and the flotation device to a desired location; then (d) releasing the flotation device from the base section to allow downward vertical movement of the platform relative to the flotation device while the flotation device remains floating and at least partially surrounding the tower section, and pumping water into a chamber of the platform to cause the platform to move downward relative to the flotation device to a deeper partially submerged position; then (e) disengaging the flotation device from the tower section; and wherein the step of securing the flotation device in step (b) comprises completely surrounding the tower section with the flotation device.

11. A method for deploying an offshore well facility, comprising:

(a) providing a platform with an elongated upper tower section and a lower base section, the base section having a greater horizontal cross-sectional than the tower section;

(b) securing a flotation device to the base section at least partially surrounding the tower section, the flotation device causing the platform to float in a towing position with the base fully submerged and the flotation device partially submerged; then (c) towing the platform and the flotation device to a desired location; then (d) releasing the flotation device from the base section to allow downward vertical movement of the platform relative to the flotation device while the flotation device remains floating and at least partially surrounding the tower section, and pumping water into a chamber of the platform to cause the platform to move downward relative to the flotation device to a deeper partially submerged position; then (e) disengaging the flotation device from the tower section; and wherein the step of securing the flotation device in step (b) comprises completely surrounding a lower portion of the tower section with the flotation device and also surrounding at least an upper portion of the base with the flotation device.

12. A method for deploying an offshore well facility, comprising:

(a) providing a platform with an elongated upper tower section and a lower base section, the base section having a greater horizontal cross-sectional than the tower section;

(b) securing a flotation device to the base section at least partially surrounding the tower section, the flotation device causing the platform to float in a towing position with the base fully submerged and the flotation device partially submerged; then (c) towing the platform and the flotation device to a desired location; then (d) releasing the flotation device from the base section to allow downward vertical movement of the platform relative to the flotation device while the flotation device remains floating and at least partially surrounding the tower section, and pumping water into a chamber of the platform to cause the platform to move downward relative to the flotation device to a deeper partially submerged position; then (e) disengaging the flotation device from the tower section; and after the flotation device is disengaged:

mounting an upper deck structure on a buoyant member that has two laterally spaced apart arms;

floating the arms on opposite sides of the tower section, with the deck structure spaced above an upper end of the tower section; then allowing the platform to become less submerged, causing the upper end of the tower section to move upward and lift the deck structure from the buoyant member; and attaching the deck structure to the upper end of the tower section and removing the buoyant member.

13. An offshore well facility, comprising:

a platform having a variable ballast;

a flotation device secured and extending around part of the platform while in a towing position, the flotation device and a lower portion of the platform being partially submerged with an upper portion of the platform extending above the flotation device while in the towing position;

the flotation device having a deploying position, wherein the ballast of the platform is increased, causing the platform to move downward relative to the flotation device from the towing position to a deeper partially submerged position while the flotation device remains floating and extending around the upper portion of the platform to provide stability against heeling;

the flotation device being releasable from the platform once the platform is submerged sufficiently to become stabile; and the platform having sufficient buoyancy to remain floating after the flotation device is released from the platform.

14. The facility according to claim 13, wherein the flotation device is secured to the platform adjacent a bottom of the platform.

15. An offshore well facility, comprising:

a platform having a variable ballast;

a flotation device secured and extending around part of the platform while in a towing position, the flotation device and a lower portion of the platform being partially submerged with an upper portion of the platform extending above the flotation device while in the towing position;

the flotation device having a deploying position, wherein the ballast of the platform is increased, causing the platform to move downward relative to the flotation device from the towing position to a deeper partially submerged position while the flotation device remains floating and extending around the upper portion of the platform to provide stability against heeling;

the flotation device being releasable from the platform once the platform is submerged sufficiently to become stabile; and wherein the flotation device is annular and formed of circumferentially extending segments that are separable from each other to release the flotation device from the platform.

16. An offshore well facility, comprising:

a platform having a variable ballast;

a flotation device secured and extending around part of the platform while in a towing position, the flotation device and a lower portion of the platform being partially submerged with an upper portion of the platform extending above the flotation device while in the towing position;

the flotation device having a deploying position, wherein the ballast of the platform is increased, causing the platform to move downward relative to the flotation device from the towing position to a deeper partially submerged position while the flotation device remains floating and extending around the upper portion of the platform to provide stability against heeling;

the flotation device being releasable from the platform once the platform is submerged sufficiently to become stabile;

an upper deck structure;

a buoyant member that has two laterally spaced apart arms, the upper deck structure being carried on the buoyant member while in a towing position;

the arms being positionable on opposite sides of the platform, with the deck structure spaced above an upper end of the platform, enabling the ballast of the platform to be decreased to cause the upper end of the platform to move upward to support the deck structure; and the buoyant member being disengagable from the upper deck structure and the platform.

17. An offshore well facility, comprising:

a platform having an upper elongated tower section and a lower base section that has a greater horizontal cross-section than the tower section;

a plurality of circumferentially extending segments that secure to each other to define an annular flotation device, the flotation device extending around a lower portion of the tower section on top of the base section while in a towing position, the flotation device being fastened to the platform by a set of fasteners while in the towing position and having sufficient buoyancy to cause the platform to float with base section submerged, the flotation device partially submerged, and an upper portion of the platform extending above the flotation device;

the flotation device having a deploying position wherein the fasteners are released, enabling ballast of the platform to be increased, causing the platform to move downward relative to the flotation device from the towing position to a deeper partially submerged position while the flotation device remains floating and extending around the tower section to provide stability against heeling; and at least some of the segments of the flotation device being releasable from each other to enable them to be pulled away from the platform once the platform is submerged sufficiently to stabilize the platform.

18. The facility of claim 17, wherein the each of the segments is separately sealed so as to be independently buoyant.

19. A stabilizing apparatus for use in towing an offshore well platform, comprising:

a flotation device having a configuration for extending around a portion of the platform;

a set of fasteners for rigidly fastening the flotation device to the platform around a bottom portion of the platform while in a towing position with both the platform and the flotation device being partially submerged;

the fasteners being releasable to enable the platform to move downward relative to the flotation device at a designated site while the flotation device remains floating and extending around the upper portion of the platform; and the flotation device being removable from the platform once the platform is submerged sufficiently to stabilize the platform.

20. A stabilizing apparatus for use in towing an offshore well platform, comprising:

a flotation device having a configuration for extending around a portion of the platform;

a set of fasteners for fastening the flotation device to the platform while in a towing position with both the platform and the flotation device being partially submerged;

the fasteners being releasable to enable the platform to move downward relative to the flotation device at a designated site while the flotation device remains floating and extending around the upper portion of the platform;

the flotation device being removable from the platform once the platform is submerged sufficiently to stabilize the platform; and wherein the flotation device comprises an annular member.

21. A stabilizing apparatus for use in towing an offshore well platform, comprising:

a plurality of segments that secure to each other to define an annular flotation device for extending around a portion of the platform;

a set of fasteners for fastening the flotation device to the platform while in a towing position with both the flotation device and the platform being partially submerged and an upper portion of the platform protruding above the flotation device;

the fasteners being releasable to enable the platform to move downward relative to the flotation device at adesignated site while the flotation device remains floating and extending around the upper portion of the platform; and at least some of the segments of the flotation device being separable from each other to enable them to be pulled away from the upper portion of the platform once the platform is submerged sufficiently to become stabile.

22. The stabilizing apparatus according to claim 21 wherein the flotation device has circular inner and outer diameters.

23. The stabilizing apparatus according to claim 21 wherein the segments comprise watertight chambers that are independently sealed from each other so that each segment is independently buoyant.

* * * * *